US005227844A

United States Patent [19]

Bhattacharjee et al.

[11] Patent Number: 5,227,844

[45] Date of Patent: Jul. 13, 1993

[54] CLEANING SHEET AND METHOD FOR CLEANING PAPER PATH FEED ROLLER SURFACES

[75] Inventors: Himangshu R. Bhattacharjee, Randolph; Edward Paley, Saddle River; Steven J. Paley, Paramus; Vincent C. Caputo, Fair Lawn; Arthur Jacob, Teaneck, all of N.J.

[73] Assignee: The Texwipe Company, Upper Saddle River, N.J.

[21] Appl. No.: 771,156

[22] Filed: Oct. 3, 1991

[51] Int. Cl.[5] ..... G03G 21/00

[52] U.S. Cl. ..... 355/215; 15/104.93; 355/296

[58] Field of Search ..... 162/199, 272; 15/104.12, 104 A, 104.93; 355/296, 297, 283, 215, 282

[56] References Cited

U.S. PATENT DOCUMENTS

| | | | |
|---|---|---|---|
| 2,796,367 | 6/1957 | Brown | 134/6 |
| 4,357,615 | 11/1982 | Yoshiharu et al. | 346/134 |
| 4,402,599 | 9/1983 | Seto | 355/296 X |
| 4,611,361 | 9/1986 | Shinkai | 15/104.93 |
| 4,686,132 | 8/1987 | Sumii et al. | 15/104.93 X |
| 4,891,265 | 1/1990 | Samagalsky | 15/104.43 X |
| 4,933,015 | 6/1990 | White | 15/104.94 |
| 5,026,587 | 6/1991 | Austin et al. | 428/91 |
| 5,138,390 | 8/1992 | Miyabayashi et al. | 355/283 |
| 5,153,964 | 10/1992 | Gelardi et al. | 355/296 X |

FOREIGN PATENT DOCUMENTS

| | | |
|---|---|---|
| 2-198934 | 8/1990 | Japan . |
| 2-213889 | 8/1990 | Japan . |
| 3-54588 | 3/1991 | Japan . |
| 3-58074 | 3/1991 | Japan . |
| 3-116081 | 5/1991 | Japan . |
| 3-117962 | 5/1991 | Japan . |

*Primary Examiner*—A. T. Grimley
*Assistant Examiner*—Nestor R. Ramirez
*Attorney, Agent, or Firm*—Samuelson & Jacob

[57] ABSTRACT

The feed surfaces of feed rollers along the paper path of an imaging machine are cleaned by passing a cleaning sheet along the paper path through the imaging machine, the cleaning sheet including a substrate carrying a coating of synthetic polymeric material in a pattern which assures contact between the coating and the feed surfaces to be cleaned, the material of the coating having a tack which enables the coating to pick off particles of unwanted material from the feed surfaces and capture the picked-off particles for movement with the cleaning sheet along the paper path and out of the machine.

12 Claims, 2 Drawing Sheets

CLEANING SHEET AND METHOD FOR CLEANING PAPER PATH FEED ROLLER SURFACES

The present invention relates generally to cleaning implements for cleaning operating components of business machines and pertains, more specifically, to a cleaning sheet for cleaning the feed surfaces of feed rollers located along the paper path of various imaging machines.

The development of economical imaging machines, such as photocopy machines, facsimile machines and computer controlled printers, and especially laser printers, has led to the widespread employment of such machines in industrial and commercial offices, as well as in homes and even in automobiles. Currently, the popularity of imaging machines of the type which present an image on plain paper is increasing as the costs of such machines are brought down to levels acceptable to more and more users. In these more popular imaging machines, plain paper is passed along a paper path to accept the transfer of an image onto the plain paper which is then presented as a completed copy. Feed rollers located along the paper path serve to advance the paper along the paper path through the machine.

While plain paper is the preferred material for the completed copy produced by imaging machines of the type described, normal use of these machines with plain paper results in the accumulation of particles of unwanted matter, such as paper dust and lint, on the feed surfaces of the feed rollers, thereby adversely affecting the performance of the machine. Accordingly, periodic cleaning of the feed surfaces of the feed rollers is necessary in order to maintain these machines in peak working order. It is here pointed out that throughout the discussion herein, the term "imaging machine" is meant to describe an image transfer device in which plain paper is passed along a paper path to accept the transfer of an image onto the paper for further use.

While various cleaning implements and methods have been made available for cleaning the feed surfaces of the feed rollers of imaging machines, there is a need for a simplified and economical implement and method which can be used easily and effectively by any of the very diverse users of imaging machines. The present invention provides such an implement and method and attains several objects and advantages, some of which are summarized as follows: Provides a cleaning implement in the form of a single sheet which merely is passed along the paper path, much the same as an ordinary sheet of paper, to accomplish effective cleaning of the feed surfaces of the feed rollers located along the paper path; effects cleaning of the feed surfaces in a single pass of the cleaning implement along the paper path, without leaving unwanted residue on the cleaned surfaces; employs a construction which facilitates passage of the cleaning implement along the paper path and which reduces any tendency toward becoming jammed within the machine during use of the cleaning implement and method; provides an essentially dry cleaning implement capable of cleaning the feed surfaces of feed rollers constructed of a wide variety of materials without contamination of the feed surfaces or degradation of the material of the feed rollers; enables simple packaging for ready distribution to and easy use by any of the diverse users of imaging machines; enables economical manufacture in large quantities of uniform high quality.

The above objects and advantages, as well as further objects and advantages, are attained by the present invention which may be described briefly as a cleaning sheet for cleaning the feed surfaces of feed rollers lying serially along a path of travel extending in a given direction through an imaging machine of the type which produces images on paper sheets fed through the imaging machine along the path of travel, by passing the cleaning sheet along the same path of travel through the machine and removing particles of unwanted matter from the feed surfaces as the cleaning sheet is advanced along the path of travel by forces exerted on the cleaning sheet by the feed surfaces along lines of contact between the feed surfaces and the cleaning sheet, each line of contact extending transverse to the path of travel and perpendicular to the given direction, the cleaning sheet including: a substrate having mechanical properties which include a balance of stiffness and flexibility enabling advancement of the cleaning sheet by the feed rollers along the path of travel through the imaging machine, the substrate having opposite faces and a coating of a synthetic polymeric material on an area of at least one of the opposite faces of the substrate, the area of the coating of synthetic polymeric material providing a tack sufficient to pick off the particles of unwanted matter from the feed surfaces contacted by the coating and to capture the picked-off particles for movement with the cleaning sheet along the path of travel and out of the imaging machine, without transferring deleterious amounts of synthetic polymeric material to the contacted feed surfaces, while enabling the feed surfaces to advance the cleaning sheet along the path of travel through the imaging machine.

The present invention will be understood more fully, while still further objects and advantages will become apparent, in the following detailed description of preferred embodiments of the invention illustrated in the accompanying drawing, in which.

Figure 1:
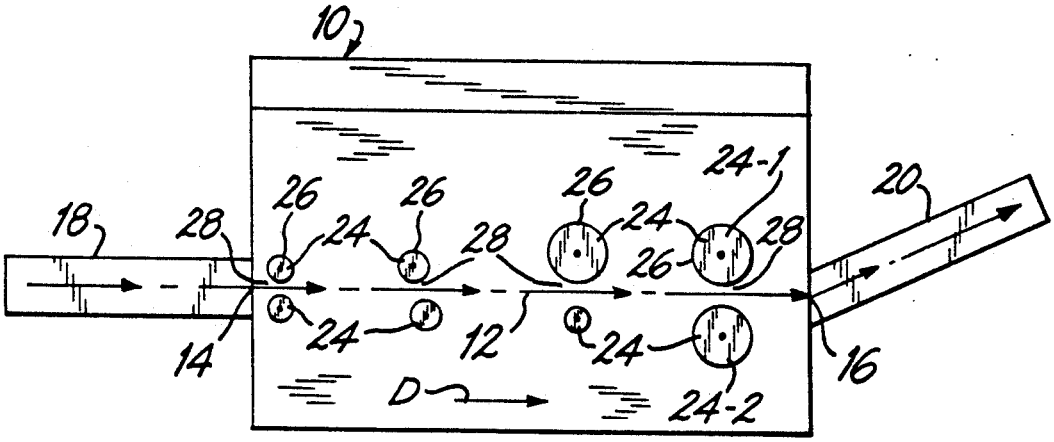
FIG. 1 is a diagrammatic elevational view of a typical imaging machine illustrating the cleaning of the feed surfaces of feed rollers located along the paper path of the imaging machine in accordance with the present invention.
Figure 2:
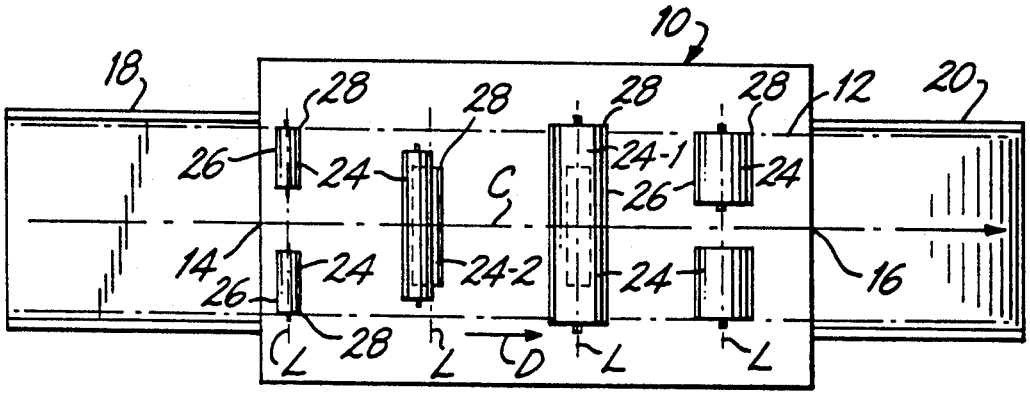
FIG. 2 is a diagrammatic plan view of the imaging machine of FIG. 1.

Referring now to the drawing, and especially to FIGS. 1 and 2 thereof, an imaging machine of the type described above is illustrated diagrammatically in the form of a photocopy machine 10 which accepts plain paper as copy paper and delivers the plain paper with images thereon, which images have been transferred to the plain paper within the machine 10, all in a now well known manner. The copy paper follows a path of travel extending in a given direction through the machine 10, shown as paper path 12 extending essentially longitudinally in the direction D from a paper entrance 14 to a paper exit 16. A copy paper supply tray 18 is placed at the paper entrance 14 and a copy paper basket 20 is placed at the paper exit 16. A plurality of feed rollers 24 is located serially along the paper path 12, the feed rollers 24 having feed surfaces 26 which engage the copy paper to advance the copy paper along the paper path 12 from the paper entrance 14 to the paper exit 16. The feed rollers 24 are arranged in feed pairs 28, each feed pair 28 including an upper feed roller 24-1 and a lower feed roller 24-2. The feed surfaces 26 of the feed rollers 24 of each feed pair 28 engage the copy paper along a line of contact L which is parallel with the axes of rotation of the feed rollers 24. The lines of contact L of all of the feed pairs 28 extend transverse to paper path 12 and are laterally perpendicular to the direction D, and the feed pairs 28 are arranged symmetrically with respect to the longitudinal centerline C of the paper path 12 so that the copy paper will not tend to skew away from the direction D as the copy paper passes along the paper path 12.

As the copy paper engages each feed roller 24, paper dust, lint and other particles of unwanted matter, such as displaced toner, carried by the copy paper will be deposited on the feed surfaces 26. After awhile, these particles of unwanted matter will accumulate until the frictional forces between the feed surfaces 26 and the copy paper is diminished to the point where advancement of the copy paper along the paper path is affected adversely. In order to maintain the operation of machine 10 at peak effectiveness, it becomes necessary to clean away the particles of unwanted matter from the feed surfaces 26, preferably even before reaching the point where the frictional forces are so diminished. Thus, regular periodic cleaning is recommended.

Figure 3:
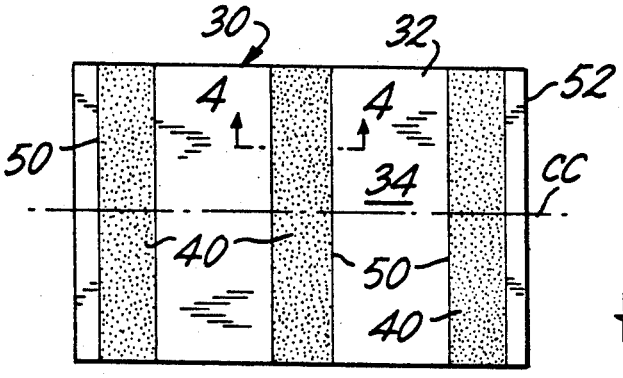
FIG. 3 is a plan view of a cleaning sheet constructed in accordance with the present invention.
Figure 4:
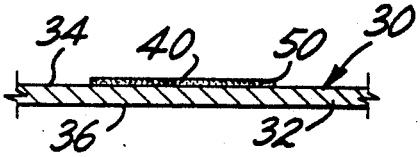
FIG. 4 is an enlarged fragmentary cross-sectional view taken along line 4—4 of FIG. 3.

In order to facilitate and encourage such regular periodic cleaning, the present invention provides a cleaning sheet 30 which is passed along the paper path 12, from the paper entrance 14 to the paper exit 16, to engage the feed surfaces 26 of the feed rollers 24 as would the copy paper itself. As best seen in FIGS. 3 and 4, cleaning sheet 30 includes a substrate 32 having opposite faces 34 and 36. Substrate 32 is constructed of a material having mechanical properties which include a balance of stiffness and flexibility enabling advancement of the cleaning sheet 30 by the feed rollers 24 along the paper path 12 through the machine 10. The preferred material is paper which has the requisite dimensional stability, while providing the cleaning sheet 30 with suitable stiffness to pass along the paper path 12 and adequate flexibility to follow any changes in the direction of the paper path 12. A coating 40 is placed upon face 34 of the substrate 32, and the material of the coating 40 has a tack sufficient to pick off the particles of unwanted matter from the feed surfaces 26 of the feed rollers 24 and capture the picked-off particles for movement with the cleaning sheet 30 along the paper path 12 and out of the machine 10, yet not so great as to impede the ability of the feed pairs 28 to advance the cleaning sheet 30 along the paper path 12. Further, the material of coating 40 has sufficient integrity to preclude the transfer of deleterious amounts of the material to the contacted feed surfaces 26. Coating 40 is a synthetic polymeric material, preferably in the form of an acrylic latex having the appropriate tack and integrity. The material of coating 40 is dry; that is, the material is not deposited upon the substrate 32 with a solvent which could have deleterious effects on some materials, such as rubber, used in the construction of the feed rollers 24.

Figure 5:
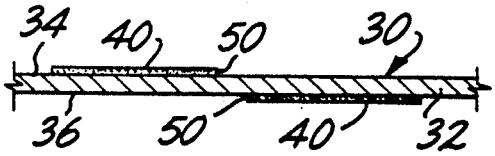
FIG. 5 is a fragmentary cross-sectional view similar to FIG. 4, but showing an alternate embodiment.

While it is preferable to place coating 40 on only the one face 34, as seen in FIG. 4, so as to maintain minimum bulk and facilitate handling and use, a further coating 40 can be placed on the opposite face 36 of the substrate 32 as well, as seen in FIG. 5. The advantage of placing a coating 40 on both faces 34 and 36 is that the cleaning sheet 30 then is able to clean the feed surfaces 26 of all of the feed rollers 24 in a single pass through the machine 10, while a cleaning sheet 30 in which a coating 40 is provided on only one face 34 will clean only the feed surfaces 26 of those feed rollers 24 confronted by the one face 34. In the latter instance, the cleaning sheet 30 merely is passed through the machine 10 twice, once with face 34 confronting feed rollers 24-1, and once turned over, with the face 34 confronting feed rollers 24-2, so that all of the feed surfaces 26 will be contacted by coating 40 and will be cleaned. The overall length and width of the cleaning sheet 30 preferably are essentially the same as the corresponding length and width of the copy paper accommodated by machine 10 so that the feed surfaces 26 of all of the feed pairs 28 will be contacted by the coating 40 for cleaning.

The area occupied by coating 40 preferably is less than the total area of face 34 so as to reduce bulk and to minimize the drag o the feed rollers 24 as the cleaning sheet 30 is advanced along feed path 12, and thereby militate against jams. Sufficient cleaning capacity is attained even though the area of the coating 40 is limited to less than the total area of the face 34 of the substrate 32. The coating 40 is placed on the surface 34 of the substrate 32 in a pattern which tends to preclude skewing of the cleaning sheet 30 as the cleaning sheet 30 is advanced along the paper path 12. Thus, the material of coating 40 is placed such that the pattern is symmetrical about the centerline CC of the cleaning sheet 30 in directions laterally perpendicular to the centerline CC so that as the cleaning sheet 30 is advanced along the paper path 12 with centerline CC of the cleaning sheet 30 aligned with centerline C of the paper path 12, the forces exerted upon the cleaning sheet 30 by the feed pairs 28 are balanced about centerline CC along each line of contact L and any tendency toward skewing is precluded.

Preferred patterns for coating 40 are illustrated, by way of example, in FIGS. 3 through 8. Thus, in FIG. 3, the coating 40 is placed on the substrate 32 in discrete patches so that the total area of coating 40 is the sum of the areas of all of the discrete patches. The patches are in the form of stripes 50 of material extending laterally across the cleaning sheet 30, perpendicular to the centerline CC, and spaced apart longitudinally along the cleaning sheet 30. Stripes 50 are so dimensioned and arranged on the cleaning sheet 30 as to assure that the entire feed surface 26 of each feed roller 24 confronting the face 34 or 36 carrying coating 40 is contacted by the coating 40 as the cleaning sheet 30 advances along paper path 12 through machine 10. Thus, the stripes 50 extend fully across the width of cleaning sheet 30, and the longitudinal extent of each stripe 50, as well as the longitudinal placement of the stripes 50 relative to one another and relative to leading edge 52 of the cleaning sheet 30, is adjusted so that every feed roller 24 will be contacted by at least one stripe 50, or by a combination of stripes 50, which will assure that the full periphery of every feed roller 24 and, hence, the full extent of every feed surface 26, is contacted by coating 40 and is cleaned. In the embodiment of FIG. 5, where the stripes 50 of coating 40 are placed on both faces 34 and 36, the stripes on face 36 are staggered longitudinally relative to the stripes 50 on face 34 so as to enable each roller pair 28 to engage coating 40 on only one face 34 or 36 at any given instant, thereby further reducing any tendency toward jams.

Figure 6:
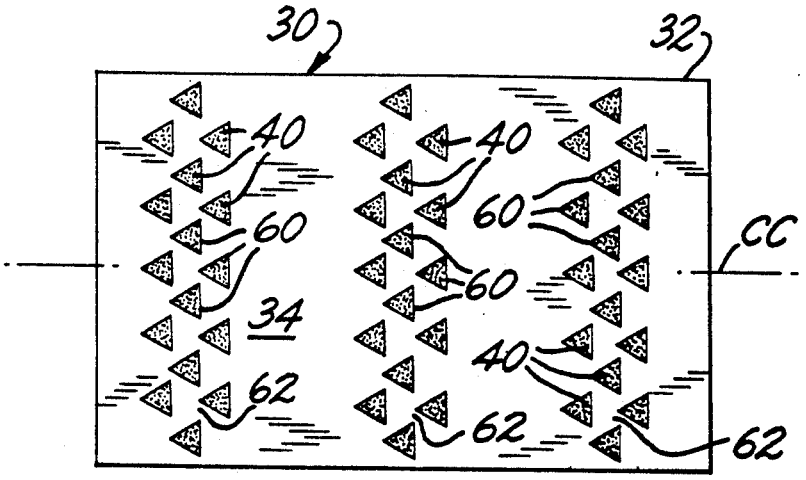
FIG. 6 is a plan view of another cleaning sheet constructed in accordance with the present invention.

In the pattern illustrated in FIG. 6, the coating 40 is placed on the substrate 32 in discrete patches, each patch being a spot having a polygonal configuration, shown in the form of triangles 60. The triangles 60 extend laterally across the cleaning sheet 30 and are staggered in longitudinal directions so as to assure that the entire feed surface 26 of each feed roller 24 confronting the face 34 or 36 carrying coating 40 is contacted by the coating 40 as the cleaning sheet 30 advances along paper path 12 through machine 10. The triangles 60 are shown arranged in stripe-like clusters 62, extending laterally fully across the width of the cleaning sheet 30 and spaced apart longitudinally along the length of the cleaning sheet 30, for conservation of coating material. By thus reducing the area of coating 40, coating material is conserved, bulk is reduced and dimensional stability of the cleaning sheet is enhanced, without sacrificing cleaning effectiveness.

Figure 7:
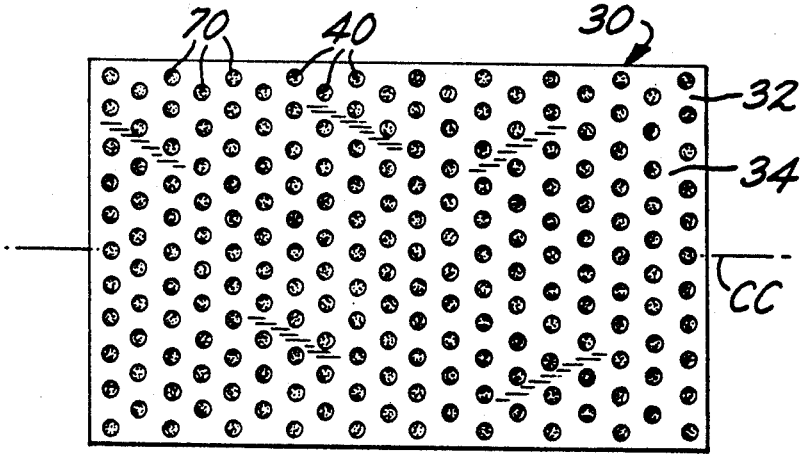
FIG. 7 is a plan view of still another cleaning sheet constructed in accordance with the present invention.

The pattern illustrated in FIG. 7 is somewhat similar to that of FIG. 6 in that coating 40 is placed in a pattern of discrete patches; however, the discrete patches are spots in the form of circles 70 of coating 40. As in the pattern described in connection with FIG. 6, the circles 70 extend laterally across the cleaning sheet 30 and are staggered in longitudinal directions so as to assure that the entire feed surface 26 of each feed roller 24 confronting the face 34 or 36 carrying coating 40 is contacted by the coating 40 as the cleaning sheet 30 advances along paper path 12 through machine 10. The circles 70 are spaced apart longitudinally as well as laterally and are spread throughout the length of the cleaning sheet 30, for purposes of dimensional stability, but can be arranged in clusters, spaced apart longitudinally along the length of the cleaning sheet 30, as are the triangles 60 of the embodiment of FIG. 6, for even greater conservation of coating material. By reducing the area of coating 40, through the use of discrete patches, coating material is conserved, bulk is reduced and dimensional stability of the cleaning sheet 30 is enhanced, without sacrificing cleaning effectiveness.

Figure 8:
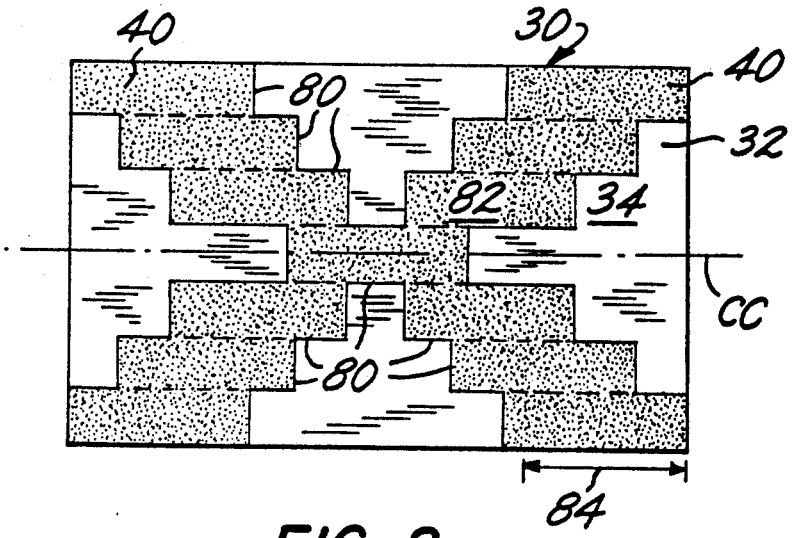
FIG. 8 is a plan view of yet another cleaning sheet constructed in accordance with the present invention.

In the pattern illustrated in FIG. 8, the coating 40 is placed on the substrate 32 in a configuration which includes longitudinally extending segments 80 joined together in an integrated area 82 which is less than the full area of the cleaning sheet 30. The pattern is symmetrical about the centerline CC, and the longitudinal length 84 of each segment 80 is sufficient to assure that the entire feed surface 26 of each feed roller 24 confronting the face 34 or 36 carrying coating 40 is contacted by the coating 40 as the cleaning sheet 30 advances along paper path 12 through machine 10. Thus, the longitudinal length 84 of each segment 80 is at least as long as the circumference of the largest diameter feed roller 24 so as to assure that the full periphery of every feed roller 24 and, hence, the full extent of every feed surface 26, is contacted by coating 40 and is cleaned. The segments 80 are staggered longitudinally relative to one another and corresponding segments 80 are spaced apart longitudinally from one another so as to reduce further any tendency toward jams.

It will be seen that the present invention attains all of the objects and advantages summarized above; namely: Provides a cleaning implement in the form of a single sheet which merely is passed along the paper path, much the same as an ordinary sheet of paper, to accomplish effective cleaning of the feed surfaces of the feed rollers located along the paper path; effects cleaning of the feed surfaces in a single pass of the cleaning implement along the paper path, without leaving unwanted residue on the cleaned surfaces; employs a construction which facilitates passage of the cleaning implement along the paper path and which reduces any tendency toward becoming jammed within the machine during use of the cleaning implement and method; provides an essentially dry cleaning implement capable of cleaning the feed surfaces of feed rollers constructed of a wide variety of materials without contamination of the feed surfaces or degradation of the material of the feed rollers; enables simple packaging for ready distribution to and easy use by any of the diverse users of imaging machines; enables economical manufacture in large quantities of uniform high quality.

It is to be understood that the above detailed description of preferred embodiments of the invention is provided by way of example only. Various details of design, construction and procedure may be modified without departing from the true spirit and scope of the invention as set forth in the appended claims.

The embodiments of the invention in which an exclusive property or privilege is claimed are defined as follows:

1. A cleaning sheet for cleaning the feed surfaces of feed rollers lying serially along a path of travel extending in a given direction through an imaging machine of the type which produces images on paper sheets fed through the imaging machine along the path of travel, by removing particles of unwanted matter form the feed surfaces as the cleaning sheet is advanced along the path of travel by forces exerted on the cleaning sheet by the feed surfaces along lines of contact between the feed surfaces and the cleaning sheet, each line of contact extending transverse to the path of travel and perpendicular to the given direction, the cleaning sheet comprising:

a substrate having mechanical properties which include a balance of stiffness and flexibility enabling advancement of the cleaning sheet by the feed rollers along the path of travel through the imaging machine, the substrate having opposite faces; and a coating of a synthetic polymeric material on an area of at least one of the opposite faces of the substrate, the area of the coating of synthetic polymeric material being less than the total area of the substrate of the cleaning sheet and providing a tack sufficient to pick off the particles of unwanted matter from the feed surface contacted by the coating and to capture the picked-off particles for movement with the cleaning sheet along the path of travel and out of the imaging machine, without referring deleterious amounts of synthetic polymeric material to the contacted feed surfaces, while enabling the feed surfaces to advance the cleaning sheet along the path of travel through the imaging machine;

the coating being placed on the substrate in a pattern which assures that the forces exerted upon the cleaning sheet by the feed surfaces are balanced along each line of contact so as to essentially preclude skewing of the cleaning sheet as the cleaning sheet is advanced along the path of travel, the cleaning sheet including a longitudinal centerline for orientation longitudinally parallel with the path of travel when the cleaning sheet is advanced through the imaging machine, and the pattern being symmetrical about the centerline in directions laterally perpendicular to the centerline and establishing longitudinally spaced apart portions of the coating along the substrate so as to reduce drag on the feed rollers as the cleaning sheet is advanced along the path of travel through the imaging machine.

2. The invention of claim 1 wherein the feed rollers each have a predetermined diameter and circumference and the pattern includes segments having a longitudinal length at least as great as the circumference of the feed rollers of largest diameter.

3. The invention of claim 2 wherein the segments are staggered longitudinally relative to one another.

4. The invention of claim 1 wherein the coating is placed on the substrate in discrete patches, the area of the coating being the sum of the areas of the discrete patches.

5. The invention of claim 4 wherein the patches are placed in a pattern which assures that the forces exerted upon the cleaning sheet by the feed surfaces are balanced along each line of contact so as essentially to preclude skewing of the cleaning sheet as the cleaning sheet is advanced along the path of travel.

6. The invention of claim 5 wherein the cleaning sheet includes a longitudinal centerline for orientation longitudinally parallel with the path of travel when the cleaning sheet is advanced through the imaging machine, and the pattern of patches is symmetrical about the centerline in directions laterally perpendicular to the centerline.

7. The invention of claim 6 wherein the pattern includes patches in the form of stripes of the synthetic polymeric material extending laterally across the cleaning sheet, perpendicular to the centerline and spaced apart longitudinally along the cleaning sheet.

8. The invention of claim 7 wherein the stripes are so dimensioned and arranged on the cleaning sheet as to assure that essentially the entire feed surface of each feed roller confronting the face of the substrate upon which the coating is placed is contacted by the synthetic polymeric material as the cleaning sheet advances along the path of travel through the imaging machine.

9. The invention of claim 6 wherein the pattern includes patches in the form of spots of the synthetic polymeric material extending over the cleaning sheet, the spots being spaced longitudinally and laterally from one another.

10. The invention of claim 9 wherein the spots are so dimensioned and arranged on the cleaning sheet as to assure that essentially the entire feed surface of each feed roller confronting the face of the substrate upon which the coating is placed is contacted by the synthetic polymeric material as the cleaning sheet advances along the path of travel through the imaging machine.

11. The invention of claim 10 wherein the spots each have a polygonal configuration.

12. The invention of claim 10 wherein the spots each have a circular configuration.

* * * * *